United States Patent [19]

Prosen

[11] 4,148,284

[45] Apr. 10, 1979

[54] VARIABLE COMPRESSION RATIO ENGINE

[75] Inventor: Gildo G. Prosen, Chicago, Ill.

[73] Assignee: Promac Corporation, Glenview, Ill.

[21] Appl. No.: 767,306

[22] Filed: Feb. 10, 1977

[51] Int. Cl.[2] ..... F02B 75/04

[52] U.S. Cl. ..... 123/78 C; 123/48 C; 123/78 AA

[58] Field of Search ..... 123/48 R, 48 C, 78 R, 123/78 AA, 78 C

[56] References Cited

U.S. PATENT DOCUMENTS

| | | | |
|---|---|---|---|
| 752,936 | 2/1904 | Vogt | 123/78 AA |
| 1,360,366 | 11/1920 | Charter | 123/48 C |
| 1,979,746 | 11/1934 | Kenneweg | 123/78 AA |
| 2,206,027 | 7/1940 | Butler | 123/78 AA |
| 2,414,217 | 1/1947 | Weiss et al. | 123/78 AA |

FOREIGN PATENT DOCUMENTS

| | | | |
|---|---|---|---|
| 2504919 | 8/1976 | Fed. Rep. of Germany | 123/78 R |
| 150079 | 10/1931 | Switzerland | 123/78 AA |

*Primary Examiner*—Charles J. Myhre
*Assistant Examiner*—David D. Reynolds
*Attorney, Agent, or Firm*—Vogel, Dithmar, Stotland, Stratman & Levy

[57] ABSTRACT

A two-part variable compression ratio cylinder is provided having inner and outer sleeves wherein relative movement between the sleeves varies the volume of the combustion chamber and hence varies the compression ratio of the engine. Hydraulic means responsive to the pressure in the combustion chamber automatically varies the position of the inner and outer sleeves to regulate the combustion chamber volume. The hydraulic controls are located entirely in the cylinder head facilitating the conversion of any internal combustion engine without altering the piston size.

10 Claims, 2 Drawing Figures

VARIABLE COMPRESSION RATIO ENGINE

RELATED APPLICATIONS

This is an improvement of my co-pending application Ser. No. 762,109, filed the 24th day of January, 1977, for "Variable Compression Ratio Engine", the disclosure of which is incorporated herein by reference.

BACKGROUND OF THE INVENTION

The present invention relates to an internal combustion engine, particularly to such engines employing means for varying the compression ratio thereof and more particularly to improved means for controlling relative movement of two-part cylinders for such engines. Variable compression ratio (VCR) engines are well known in the art and variations thereof are disclosed in U.S. Pat. No. 2,215,986 issued Sept. 24, 1940 to Stevens, U.S. Pat. No. 2,375,183 issued May 8, 1945 to Arden, U.S. Pat. No. 2,419,450 issued Apr. 22, 1947 to Howard and U.S. Pat. No. 2,769,433 issued Nov. 6, 1956 to Humphreys.

In each of the aforesaid patents, a VCR engine is disclosed in which the combustion chamber volume is varied either by adjusting the piston shape or path or by adjusting the cylinder volume. However, none of the referred to patents shows or suggests the two-part cylinder of the present invention in which an integral combustion chamber is formed by the inner cylinder and the piston, thereby minimizing the loss combustion pressure.

The present invention provides a construction wherein the loss of combustion pressure is minimized and also a construction wherein the loss of hydraulic fluid or oil is also minimized. Moreover, the present invention is relatively simple to construct and can be adapted to a wide variety of internal combustion engines, all without reducing the piston diameter.

SUMMARY OF THE INVENTION

This invention relates to a VCR engine and more particularly to a VCR engine in which the combustion chamber is constructed to provide minimum possibilities for escape of the gases during combustion to enhance the efficiency of the engine.

An important object of the present invention is to provide a VCR engine in which a two-part cylinder including inner and outer sleeves is utilized automatically to adjust and control the combustion chamber volume as well as the effective area of the inlet and outlet ports.

Another object of the present invention is to provide a VCR engine in which the loss of oil is minimized by the construction provided.

Still another object of the present invention is to provide a construction for adapting a wide variety of internal combustion engines to the VCR type without reducing the piston diameter thereby greatly increasing engine power.

Another object of the present invention is to provide an internal combustion engine having a combustion chamber, means for automatically varying the volume of the combustion chamber, comprising a cylinder having inner and outer sleeves, the inner sleeve defining at least a portion of the combustion chamber, a cylinder head associated with the inner and outer sleeves, and means in the cylinder head providing relative movement between the inner and outer sleeves to vary the volume of the combustion chamber, the means being responsive to pressure in the combustion chamber to increase the combustion chamber volume in response to an increase in pressure and to decrease the combustion chamber volume in response to a decreasing pressure.

Still another object of the present invention is to provide an internal combustion engine of the type set forth in which first and second fluid chambers are formed by the inner sleeve and cylinder head and means connecting the first and second fluid chambers to a fluid supply providing a constant source of fluid to the chambers.

A further object of the present invention is to provide an internal combustion engine of the type set forth in which the inner sleeve has an integral closed end forming a dome-shaped combustion chamber.

A still further object of the present invention is to provide an internal combustion engine having a combustion chamber, means for automatically varying the volume of the combustion chamber comprising, a cylinder having inner and outer sleeves, the inner sleeve having an integral closed end forming with an associated piston, a dome-shaped combustion chamber, the upper end of the inner sleeve having a reduced diameter, the outer sleeve being fixed against movement and forming an outer tube for the inner sleeve, an annular cylinder head having an inwardly extending portion mating with the reduced diameter portion of the inner sleeve, the inner sleeve in combination with the cylinder head forming upper and lower chambers, means extending through the cylinder head connecting the upper and lower chambers to an associated source of fluid and providing fluid under pressure to the upper and lower chambers, means for maintaining the fluid in the lower chamber at a higher pressure than the fluid in the upper chamber when the engine load is less than a preselected value, and means for releasing the fluid in the lower chamber in response to an engine load in excess of the preselected value to permit relative movement between the inner sleeve and the cylinder head to increase the combustion chamber size, thereby decreasing the compression ratio.

Still further objects and advantages of the present invention will be readily apparent upon reference to the following description of several preferred embodiments thereof and which refers to the accompanying drawings:

DESCRIPTION OF THE PREFERRED EMBODIMENTS

Figure 1:
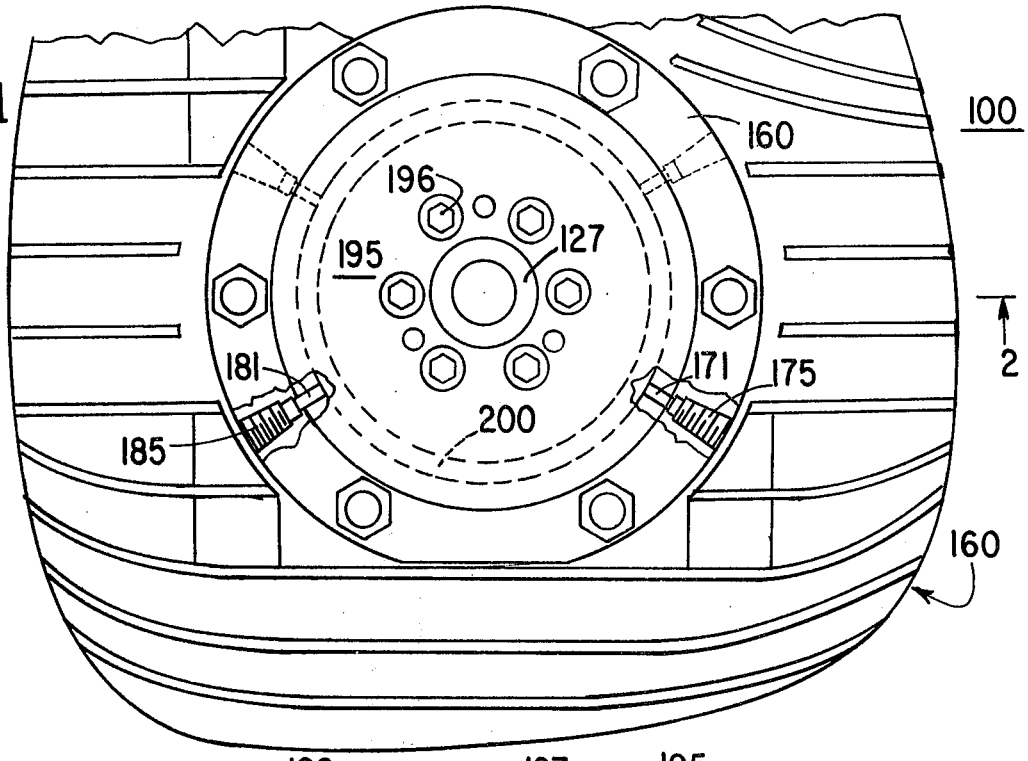
FIG. 1 is a top plan view of a cylinder head assembly.
Figure 2:
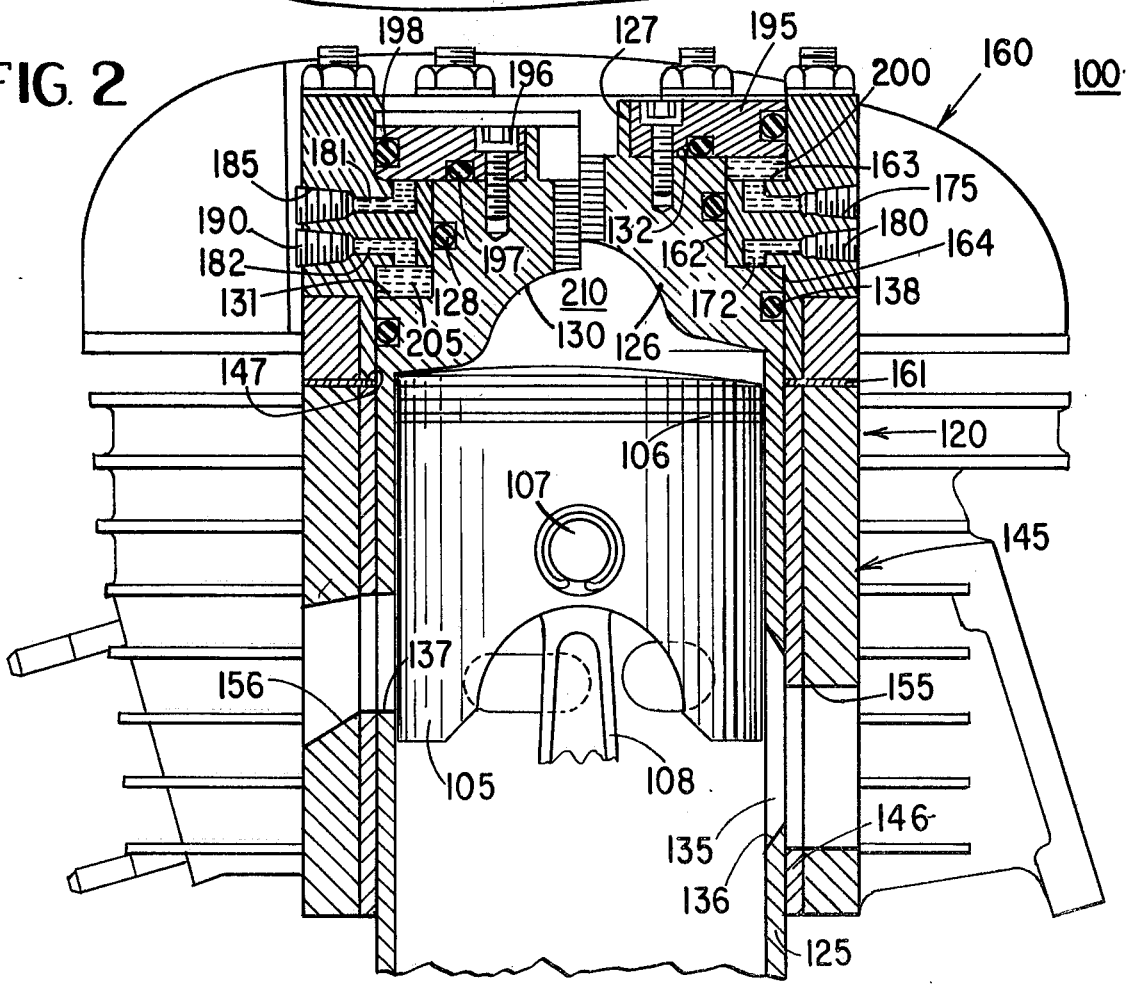
FIG. 2 is a vertical cross section view of the cylinder head assembly illustrated in FIG. 1, as seen along lines 2—2 thereof, particularly illustrating the high and low compression positions of the sleeve and head.

Referring now to FIGS. 1 and 2, there is disclosed a two-stroke internal combustion engine 100 having a piston 105 with the usual rings 106. A connecting rod 108 interconnects the piston pin 107 with the crank in the crank case (not shown) all in the usual manner.

A two-part cylinder 120 is provided with an elongated inner sleeve 125 having an upstanding closed top portion 126 having a reduced diameter which accommodates a spark plug seat 127 therein. The top portion 126 of the inner sleeve 125 is provided with O-rings or piston rings 128 of a resilient material, all as is well known. The inner sleeve 125 of the two-part cylinder 120 and particularly the top portion 126 thereof has a dome-shaped interior surface 130 and a flat outwardly extending annular surface 131. The exterior top surface 132 of the portion 126 is flat and circular in shape. An inlet aperture 135 extends through the cylindrical inner sleeve 125 and has beveled edges 136 and an outlet aperture 137 also extends through the side of the cylindrical sleeve 125. O-rings or piston rings 138 are provided in the cylindrical sleeve 125 below the reduced portion 126.

The two-part cylinder 120 also includes an outer sleeve 145, which outer sleeve is cylindrical in shape with an inner cylindrical wall or surface 146 and a flat top surface 147. The wall or surface 146 may be separate from the sleeve 145 or may be plated, as a thin chromium plate is sometimes used, all as is standard in the art.

The outer sleeve 145 is provided with a gas passageway 155 in registry with the aperture or port 135 of the inner sleeve 125. Similarly, another aperture 156 is provided extending through the sleeve 145 in alignment with the aperture 137 in the inner sleeve 125.

The annular cylinder head assembly 160 fits snugly around the top portion 126 of the inner cylinder 125 and rests on the upper surface 147 of the outer sleeve 145, a gasket 161 being provided to form a seal between the cylinder head assembly 160 and the outer sleeve 145. The cylinder head assembly 160 has an inwardly extending annular portion 162 having an upper surface 163 and a lower surface 164. Provided in the cylinder head assembly 160 is an oil passageway 171 in communication with the upper surface 163 and with a one-way valve 175 seat. Also provided in the cylinder head assembly 160 is an oil passageway 172 interconnecting the lower surface 164 with a one-way valve seat 180. A restrictor valve seat 185 for a valve (not shown) having a reduced diameter aperture therein is in fluid communication with the upper surface 163 by means of the oil passageway 181 and a pressure release valve seat 190 inside the cylinder head assembly 160 for a pressure release valve (not shown), is in fluid communication with the lower surface 164 by means of the passageway 182. A circular top 195 is positioned within the cylinder head assembly 160 and on top of the portion 126 of the inner sleeve 125. The top 195 is mounted to the portion 126 by bolts 196 and moves vertically therewith. O-rings 197 and 198 respectively, seal the top 195 with the sleeve 125 and the cylinder head assembly 160.

The inner sleeve 125 and the cylinder head assembly 160 cooperate to form an upper chamber 200 defined by the annular surface 163 of the cylinder head assembly 160 and the bottom surface of the top 195, which chamber 200 is in fluid communication with the valves in seats 175 and 185. A lower chamber 205 is formed between the surface 131 of the inner sleeve 125 and the annular surface 164 of the cylinder head assembly 160, the chamber 205 being in fluid communication with the valve seats 180 and 190 and hence the valves accommodated thereby. While the total volume of the chambers 200 and 205 remains constant, the individual volumes vary depending upon the position of the inner sleeve 125 with respect to the cylindrical head assembly 160.

A combustion chamber 210 is defined between the inner surface 130 of the top portion 126 of the inner sleeve 125 and the piston 105. A standard spark plug (not shown) positioned in the usual manner in the spark plug seat 127 extends into the combustion chamber 210 and operates in the usual manner. An exhaust system (not shown) is in fluid communication with the interior of the cylinder 120 by means of the aligned apertures 137 and 156. Finally, an intake system (not shown) is in fluid communication with the interior of the two-part cylinder 120 via the apertures 135 and 155. An oil pump (not shown) provides a constant oil supply to the upper and lower chambers 200 and 205 through the passageways 171 and 172.

The system is a continuous loop with oil from the crank case flowing to the chambers 200 and 205 and then being returned to the crank case, all as will hereinafter be set forth.

When the engine 100 is started, the parts are in the high compression position, seen on the left-hand side of FIG. 2. Since the restrictor valve in the seat 185 provides a continuous drain of motor oil from the upper chamber 200 to the crank case, at rest the inner sleeve 125 will move to the position illustrated, since the oil pressure in chamber 200 is less than the pressure in chamber 205. In the position illustrated on the left, the inner sleeve 125 is in its lower position and the combustion chamber 210 is at its smallest volume, whereby the engine compression ratio is the highest attainable. This is an advantageous position for start-up and at light engine loads.

When the engine 100 is started, the oil pump (not shown) in communication with the oil supply in the crank case pumps oil through passageways (not shown) to the one-way valve 180 to maintain a constant oil pressure at the one-way valve 180 and to provide a constant oil supply to the lower chamber 205. Oil in the lower chamber 205 flows therefrom through the passageways 182 to the pressure release valve in the seat 190. The pressure release valve is preset to a predetermined pressure, such as 90% of the maximum operating pressure in the combustion chamber 210. Accordingly, until the preset pressure is obtained, the pressure release valve in the seat 190 remains closed and prevents oil from escaping the chamber 205, thereby maintaining the inner sleeve 125 in the lower position thereof, as illustrated in the left-hand portion of FIG. 2.

When the load on the engine 100 increases, the pressure within the combustion chamber 210 rises and when it passes the preset pressure of the pressure release valve, the valve opens allowing oil to escape from the lower chamber 205 to the crank case. The oil flow through the pressure release valve in the seat 190 is greater than through the restrictor valve in the seat 185, while the oil supply to the valves in the seats 175 and 180 remains the same. So long as the pressure release valve is open, the volume of oil escaping chamber 205, will exceed the volume of oil escaping chamber 200, whereby the inner sleeve 125 and top 195 will move upwardly with respect to the cylinder head assembly 160, and the volume of chamber 200 will increase, while the volume of chamber 205 decreases, until the position shown on the right-hand side of FIG. 2 is reached.

So long as the pressure in the combustion chamber 210 is sufficient to maintain the pressure release valve open, the inner sleeve 125 will move upwardly with respect to the cylinder head assembly 160 until the inner sleeve reaches its uppermost position. Thereafter, for as long as the pressure in the combustion chamber 210 exceeds the preset pressure of the valve in the seat 190, the inner sleeve 125 will remain in its uppermost position relative to the cylinder head assembly 160. The valve in the seat 190 can be adjusted to control the flow rate of oil therethrough, such that an equilibrium can be attained with the sleeve 125 at an intermediate position with respect to the cylinder head assembly 160. In this case, if the engine load increases with a concurrent increase in pressure in the combustion chamber 210, then more hydraulic oil will be forced out of the lower chamber 205 and the inner sleeve 125 will move upwardly into its most upward position in which the surface 131 of the sleeve 125 is in engagement with the bottom surface 164 of the cylinder head 160, at which time the upper chamber 200 volume will be at its maximum. At this time, the compression ratio of the motor will be at its lowest, since the load on the motor will be the greatest. This provides increased operating efficiency resulting in the least amount of fuel being used to run the engine 100.

As the load decreases, beyond the point where the pressure in the combustion chamber 210 is less than the preset value of the pressure release valve in the seat 190, the valve will close and thereafter hydraulic fluid will be retained in the lower chamber 205 and the volume thereof will steadily increase until a new equilibrium is attained. The pressure release valve in the seat 190 may open and close rapidly in order to accommodate relatively rapid changes in the engine load, whereby intermediate positions of the inner sleeve 125 with respect to the cylinder head assembly 160 will be obtained. In all cases, after the engine is shut-off, the inner sleeve will move to the high compression position due to the continuing bleed through the restrictor valve in the seat 185 and hence the engine 100 will be in the high compression ratio position upon starting, a desirable characteristic.

It will be seen therefore that the engine 100 automatically adjusts between a high compression ratio condition at low engine loads and a low compression ratio condition at high engine loads to reduce engine wear, improve power output and conserve fuel. Another advantage of the present invention is the construction of the combustion chamber 210 formed by the dome-shaped inner surface 130 of the inside sleeve 125 and the top of the piston 105, which combustion chamber 210 is sealed as in a normal non-VCR engine, thereby preventing undue escape of combustion gases with the resultant loss in engine power and efficiency. This is an extremely important characteristic, since the gases in the cylinder sleeve 125 at combustion, cannot escape and must perform work on the piston 105, whereas in prior art construction the variable cylinder designs presents many areas through which combustion gases at high pressure can escape, thereby resulting in lower power output and inefficient operation.

Another feature of the present invention is the simplified hydraulic system which utilizes a state-of-the-art oil pump in the crank case 110 to provide all required hydraulics of the engine 100. This improved design is a fundamental feature of the present invention, since no intricate and expensive equipment is needed to transform a normal engine into the VCR engine of the present invention. It will be seen that adjustment of the pressure release valve in the seat 190 determines the combustion pressure or engine load necessary to cause relative movement between the inner sleeve 125 and the cylinder head assembly 160. The rapidity of oscillation of the inner sleeve 125 between the high compression and low compression position is controlled in part by the volume of the continual bleed through the restrictor valve in the seat 185. In all other respects, the present VCR engine 100 requires no additional seals beyond those normally present in a usual engine, the gaskets and O-rings being of the normal type presently employed in internal combustion engines.

Another advantage of the present invention is the positioning of all the hydraulics in the cylinder head assembly 160, thereby cooling the inner sleeve 125, while varying the compression ratio. By designing the head 160 and sleeve 125 as described, replacement is easy and does not require replacement of the piston 105. In my prior copending application, smaller pistons 105 were often needed when a standard engine was converted to my VCR design. Since power is lost by reducing the piston diameter (area) this was a disadvantage.

In this engine 100, replacement of the piston 105 is avoided which greatly enhances the ease of converting a standard engine to the present VCR design. The entire cylinder head assembly 160 and cylinder 120 can be replaced at one time, retaining the original piston 105.

Placing the hydraulics in the cylinder head assembly 160, is advantageous in that the combustion chamber 210 is sealed and combustion gases cannot escape through the assembly, thereby reducing compression and power.

As is well known, adjacent metal surfaces must not be alike, whereby if the piston 105 is aluminum, then the inner sleeve 125 must be another metal, such as steel or chrome plated aluminum. Similarly, the inner surface 146 of the outer sleeve 145 must be different from the outer surface of the inner sleeve 125 to promote relative movement therebetween.

As described, the aforementioned VCR concept, is adaptable to engines of many types and descriptions, the principle novel feature being the provision of the inner sleeve and cylinder head assembly and providing relative movement therebetween automatically in response to varying engine loads. The concept provides further advantages in that difficult sealing problems are not encountered and that engine modification is made easy by the lack of sophisticated and complex machinery required to incorporate the present system into standard engines. The advantages of VCR engines have been described in the literature and in particular in a paper entitled "A Variable Compression Ratio Engine Development" by W. A. Wallace and F. B. Lux, given in an SAE meeting, Oct. 14 to 17, 1963, in Chicago, Ill., SAE pamphlet number 762A.

A person skilled in the art will appreciate that the present invention may be used to vary compression ratios over a large range depending on initial engine design and end use. Ratios may be varied through the ranges of 5 to 1 to 10 to 1, or from 11 to 1 to 22 to 1 or higher. The basic concept remains the same, but the cylinder dimensions determine final compression ratios. Relative movement between the inner cylindrical sleeve and the cylinder head assembly, provides increased combustion efficiency and power with less loss of both gases and hydraulic fluid.

An alternative design is to vent the lower chamber to the upper chamber which does away with the need for an independent source of oil to the upper chamber. Another feature of this invention is the change in effective area of the inlet and outlet ports during movement between the high compression and low compression conditions. Lower effective area is provided thereby in the high compression condition to conserve fuel and increase engine efficiency.

While there has been described what at present is considered to be the preferred embodiment of the present invention, it will be understood that various modifications and alterations may be made therein without departing from the true spirit and scope of the present invention and it is intended to cover such variations and modifications in the appended claims.

What is claimed is:

1. In an internal combustion engine having a combustion chamber, means for automatically varying the volume of the combustion chamber comprising, a cylinder having inner and outer sleeves, said inner sleeve defining at least a portion of the combustion chamber, a stationary cylinder head housing associated with said inner and outer sleeves, and means in said cylinder head housing forming a plurality of variable capacity fluid chambers and providing relative movement between said inner sleeve and said cylinder head housing to vary the volume of the combustion chamber, said means being responsive to pressure in the combustion chamber to vary the volume of fluid in said chambers to increase the combustion chamber volume in response to an increase in pressure and to decrease the combustion chamber volume in response to a decrease in pressure.

2. The internal combustion engine set forth in claim 1, wherein said inner and outer sleeves are concentric hollow cylinders.

3. The internal combustion engine set forth in claim 1, and further comprising a cylinder head cover mounted on said inner sleeve for movement therewith.

4. In an internal combustion engine having a combustion chamber, means for automatically varying the volume of the combustion chamber comprising, a cylinder having inner and outer sleeves and a stationary cylinder head housing, said inner sleeve defining at least a portion of the combustion chamber, first and second fluid chambers formed by said inner sleeve and said cylinder head housing, means connecting said first and second fluid chambers to a fluid supply to provide a constant source of fluid to said chambers, and means for varying the volume of fluid in said first and second chambers responsive to the pressure in the combustion chamber causing relative movement of said inner sleeve and said cylinder head housing to control the combustion chamber volume in response to pressure in the combustion chamber.

5. The internal combustion engine set forth in claim 4, wherein said inner sleeve is cylindrical with one end being closed and forming the combustion chamber with the associated piston.

6. The internal combustion engine set forth in claim 4, wherein said inner sleeve has a dome-shaped top inner surface.

7. The internal combustion engine set forth in claim 4, wherein said means for varying the fluid volume includes a restrictor valve in fluid communication with said first chamber for continually draining fluid therefrom, and a pressure release valve in communication with said second chamber for preventing release of fluid from said second chamber until the pressure in the combustion chamber exceeds a predetermined value, said restrictor valve and said pressure release valve being mounted in said cylinder head.

8. The internal combustion engine set forth in claim 4, wherein said means connecting said chamber to the fluid supply includes a one-way valve between the fluid source and each chamber mounted in said cylinder head housing.

9. In an internal combustion engine having a combustion chamber, means for automatically varying the volume of the combustion chamber comprising, a cylinder having a movable inner sleeve and a fixed outer sleeve, said inner sleeve having an integral dome-shaped closed end forming with an associated piston a sealed combustion chamber, a stationary cylinder head housing having an opening therein, the upper end of said inner sleeve extending through said cylinder head opening and being movable with respect thereto, a cover on the top of said inner sleeve movable therewith, said inner sleeve and said inner sleeve cover and said cylinder head housing cooperating to form upper and lower chambers, means connecting said upper and lower chambers to an associated source of fluid and providing fluid under pressure to said upper and lower chambers, means for maintaining the fluid in said lower chamber at a higher pressure than the fluid in said upper chamber when the engine load is less than a preselected value, and means for releasing the fluid in said lower chamber in response to an engine load in excess of said preselected value to permit relative movement between said inner sleeve with said cover thereon and said cylinder head housing to increase the combustion chamber size, thereby decreasing the compression ratio.

10. The internal combustion engine set forth in claim 9, wherein said means for maintaining higher fluid pressure in said lower chamber includes a first valve for continually draining fluid from said upper chamber and a second valve for intermittently releasing fluid from said lower chamber in response to the pressure in the combustion chamber.

* * * * *